United States Patent [19]

Oehy et al.

[11] Patent Number: 4,463,480

[45] Date of Patent: Aug. 7, 1984

[54] APPARATUS AND METHOD FOR CHANGING CANS ON A SPINNING PREPARATORY MACHINE

[75] Inventors: Peter Oehy, Winterthur; René Schmid, Niederneunforn, both of, Switzerland

[73] Assignee: Rieter Machine Works, Ltd., Winterthur, Switzerland

[21] Appl. No.: 382,687

[22] Filed: May 27, 1982

[30] Foreign Application Priority Data

May 29, 1981 [CH] Switzerland ..... 3513/81

[51] Int. Cl.[3] ..... B65H 54/80

[52] U.S. Cl. ..... 19/159 A

[58] Field of Search ..... 19/159 A

[56] References Cited

U.S. PATENT DOCUMENTS 3,698,041 10/1972 Hertzsch ..... 19/159 A 3,808,641 5/1975 Schneider et al. ..... 19/159 A 4,227,848 10/1980 Kriechbaum et al. ..... 19/159 A

FOREIGN PATENT DOCUMENTS 66054 3/1982 European Pat. Off. ..... 19/159 A

*Primary Examiner*—Louis Rimrodt

*Attorney, Agent, or Firm*—Kenyon & Kenyon

[57] ABSTRACT

The can changing apparatus operates so that the full can and empty can are arranged to move in guide paths which are at a right angle to each other. A simultaneous exchange of the cans takes place with one can being shifted at a constant speed while the other can moves with a speed characteristic which corresponds to a tangent function. The support members on which the arms for pushing the cans are mounted are connected, for example by a rigid curve rod, a resiliently bendable rod, or a linked arm such that one support member moves the other.

12 Claims, 19 Drawing Figures

11
5
20
2
III
8
III
α'
α''
3
1
$s_2$
10
4
6
19
$s_1$ 20
11
5
1
3
15
16
8
18
17
6'
19
10

20
11
5
18
1
8
β
17
16
4
21
6
19

11
5
53
20
A
B
8
18
β'
17
1
16
4
6

APPARATUS AND METHOD FOR CHANGING CANS ON A SPINNING PREPARATORY MACHINE

This invention relates to an apparatus and method for changing cans on a spinning preparatory machine. More particularly, this invention relates to an apparatus and method for changing deposition cans on draw frames.

As is known, spinning preparatory machines, particularly draw frames, operate at relatively high speeds. For example, in the drafting of slivers, delivery speeds of up to thirteen meters per second and more are generally sought. As is also known, the drafted slivers are deposited into cans which when filled are removed for further processing of the sliver and replaced by empty cans for continued filling. Accordingly, in order to obtain a minimum down time period for the draw frame, the fastest possible speeds are required in order to carry out a can exchange.

In the past, it has been known to provide a can exchange device wherein a full and empty can can be shifted at the same rhythm into the next following position. An exchange device of this type is known from German Patent DAS No. 1,234,597. In such a device, the full and empty cans are shifted, using a so called rotation change principle, along a guide rail which is in the shape of a one-eighth sector of a full circle to the next position. That is, the full cans are shifted into a transfer position and the empty cans are shifted into a depositing position. In this respect, two guide rails are provided for the respective cans with each guide rail having a pivotal arm. During a backward movement of a guide rail, the pivotal arm is tilted up and, upon reaching a starting position, the arm is pivoted down again behind a can. The guide rails are arranged so that one shifts the empty can to the depositing position while the other guide rail which is arranged above shifts the full can to the tranfer position. Both rails cover the same path. The only difference is that the pivoting arm for shifting the empty can is provided on the beginning of one of the rails, as seen in the shifting direction, whereas the arm for shifting the full cans is provided at the other end of the second guide rail.

In this known device, each guide rail is driven by an individual drive motor with a drive transmission being effected via a rack on the guide rail and a pinion gear on the motor.

These known exchange devices, however, have several disadvantages. For example, one main disadvantage is that these so called rotation-change devices require, as viewed from the operating side, a relatively large amount of space, in principle, due to the pivoting range zone required. This disadvantage is particularly noticeable if the exchange device is used on two-headed draw frames which are commonly used. In such an arrangement, the considerable width of the can exchange device requires the use of a large sliver input table if unfavorable sliver deflections are to be avoided. However, this arrangement requires a substantial space over the whole length of the sliver input table.

Another disadvantage of these rotation-change devices is that the full cans are expelled about at the place at which an operator would have a favorable working condition. Thus, the operator is forced to stand at an angle with respect to the drafting arrangement which is operated. This not only impairs the accessability of the drafting arrangement but also increases the distance between the operator's position and the drafting arrangement.

Accordingly, it is an object of the invention to provide a can exchange apparatus which requires a minimum of space in a spinning preparatory machine.

It is another object of the invention to avoid encumbering an operator's position in a drafting arrangement with a can exchange apparatus.

It is another object of the invention to provide a method of rapidly exchanging filled sliver cans with empty sliver cans in a spinning preparatory machine.

Briefly, the invention provides an apparatus and method for changing cans on a spinning preparatory machine.

The apparatus comprises a pair of shiftable support members, a pair of straight guide elements, a shifting means and a drive means. The support members each have an arm movably mounted thereon between an extended position for engaging a can and a retracted position spaced from a can. The guide elements are disposed at right angles to each other and each receives a respective support member for shifting of the support member thereon. The shifting means interconnects the support members to each other in a force-transmitting manner and the drive means is connected to at least one of the support members for reciprocating the members on the respective guide elements.

In one embodiment, the shifting means is in the form of a rigid curved rod which is pivotally secured at each respective end to a respective support member.

In another embodiment, the shifting means is in the form of a resiliently bendable rod which is pivotally secured at each respective end to a respective support member. In addition, the drive means is connected to one support member while a damping means is connected to the other support member in order to retard a backward movement thereof. Thus, during a backward movement of the support members, the rod bends away from a can placed in a depositing position.

In another embodiment, the shifting means is in the form of a link rod which is pivotally secured at each end to a respective support member. In addition, the rod has at least two equal legs and a link pivotally connecting the legs together. Further, the apparatus includes a pair of guide rails each of which is parallel to a respective guide element for guiding the link thereon as well as a means for guiding the link from one guide rail to the other guide rail. This latter means may be in the form of a stop in the link for preventing a bending of the link rod below a predetermined angle.

The method comprises the steps of shifting a first can in a first direction from a depositing position to a transfer position and simultaneously shifting an empty can in a second direction substantially at a right angle to the first direction from a reserve position to the depositing position.

During operation, a can is moved from the depositing position at a predetermined rate of speed to the transfer position while the empty can is accelerated from the reserve position up to the speed of the first can at a point between the reserve position and the depositing position. In this way, the starting speed of the second can is substantially less than the speed of the first can.

During acceleration of the empty can, the range of the initial speeds has a substantially lower average speed than the speed of the filled can. This can be effected in an advantageous manner if the speed characteristic of the empty can substantially corresponds to a tangent function for an angle of 0 degrees toward 90°. Another advantage is that with a narrow arrangement of the positions of the empty and full cans, both cans can be started in such a manner that contact is avoided between the cans. Furthermore, narrow can distances permit smaller floor space of the changing apparatus with the resulting advantage that this floor space saving is effective over the whole length of a sliver input table.

These and other objects and advantages of the invention will become more apparent from the following detailed description taken in conjunction with the accompanying drawings wherein.

Figure 1:
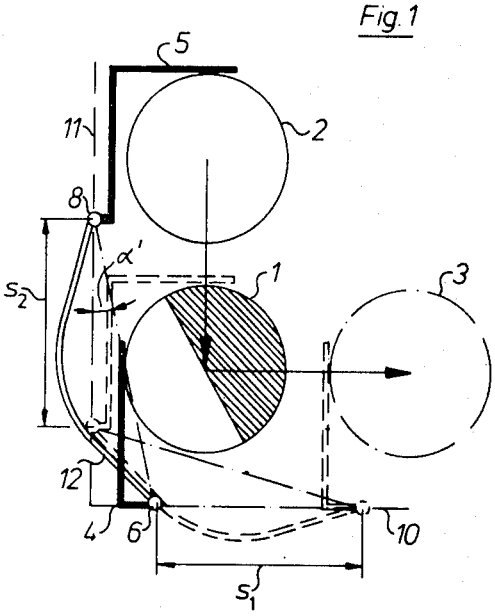
FIG. 1 illustrates a top view of a can exchange apparatus according to the invention with a full can in a depositing position.
Figure 2:
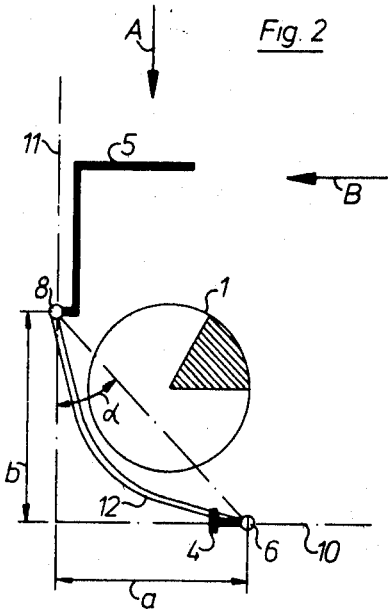
FIG. 2 illustrates a view similar to FIG. 1 with an empty can moved into the depositing position.
Figure 4:
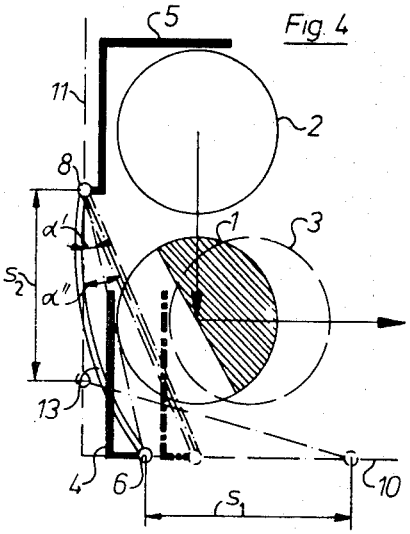
Figure 5:
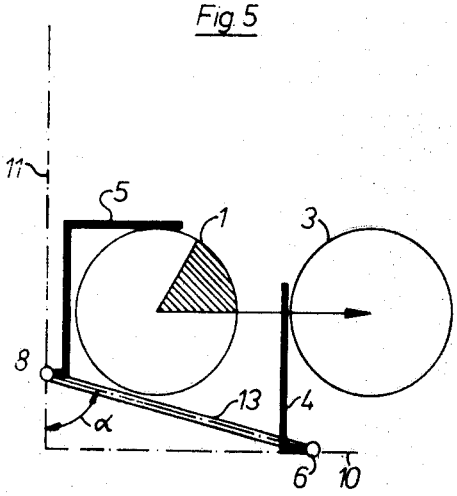
Figure 3:
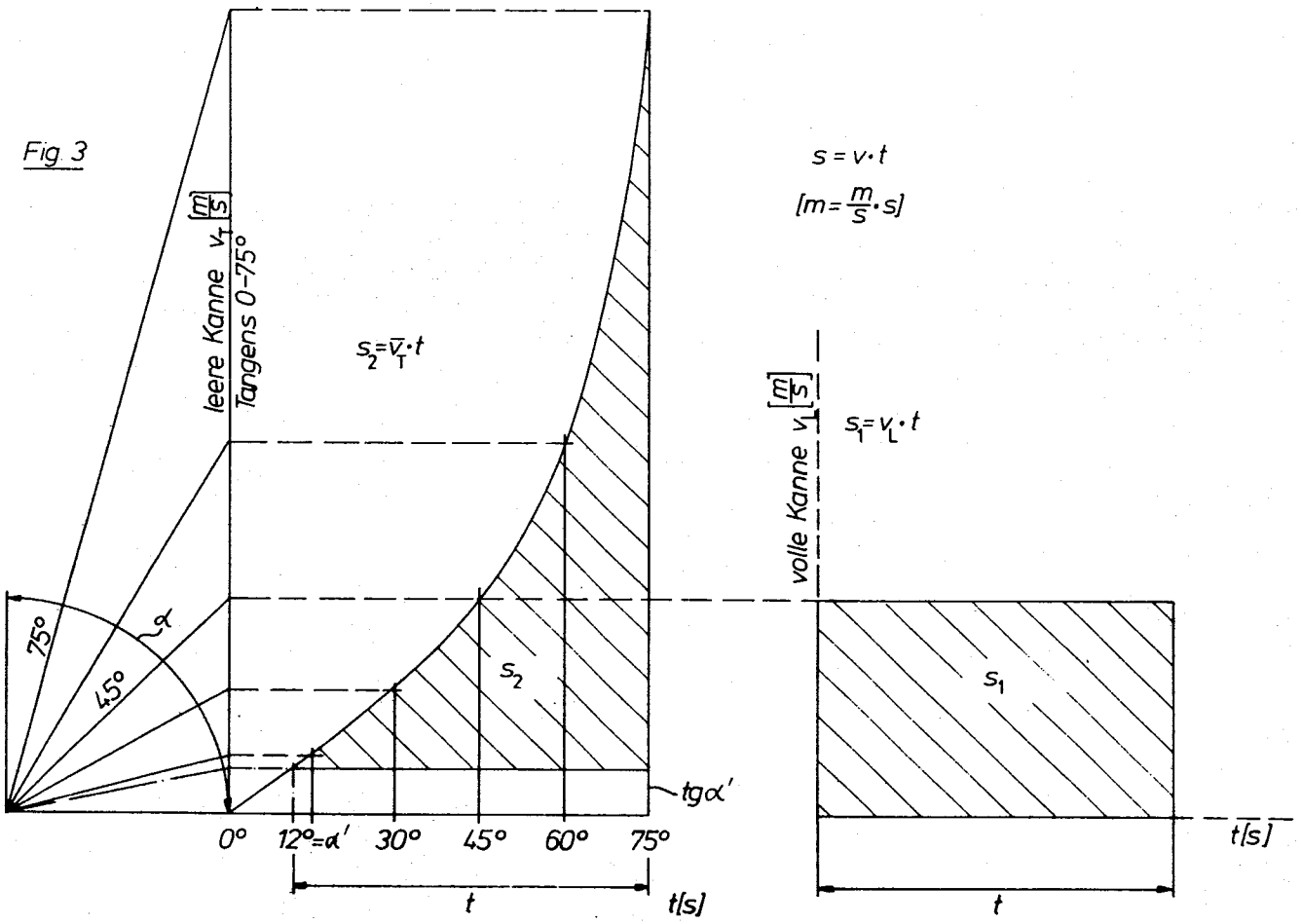
Figure 6:
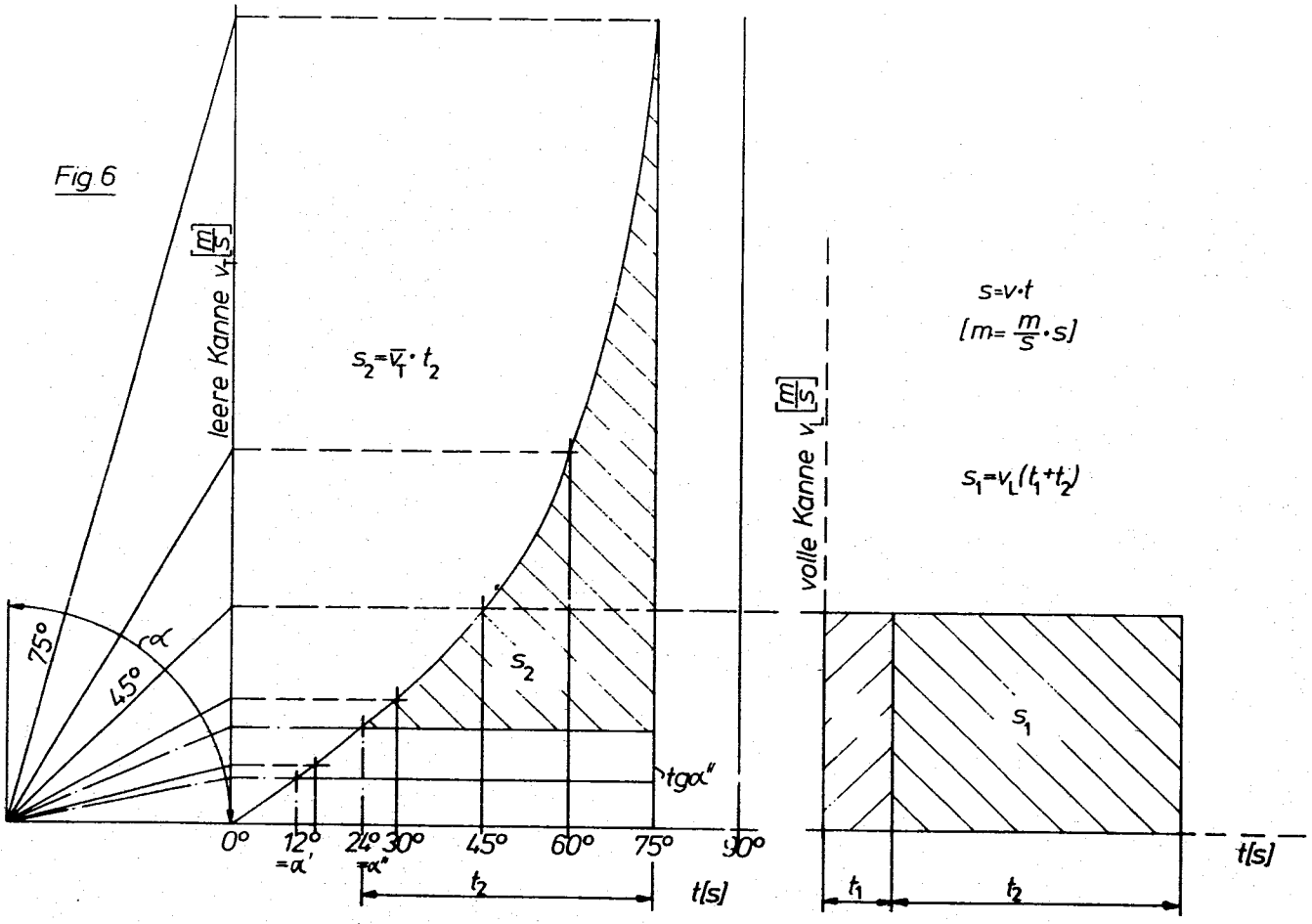
Figure 7:
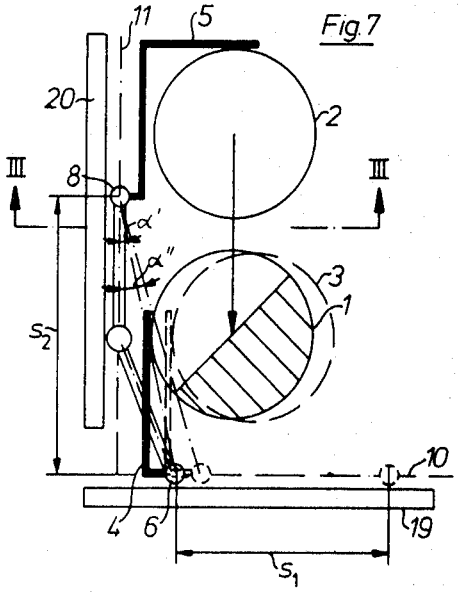
Figure 8:
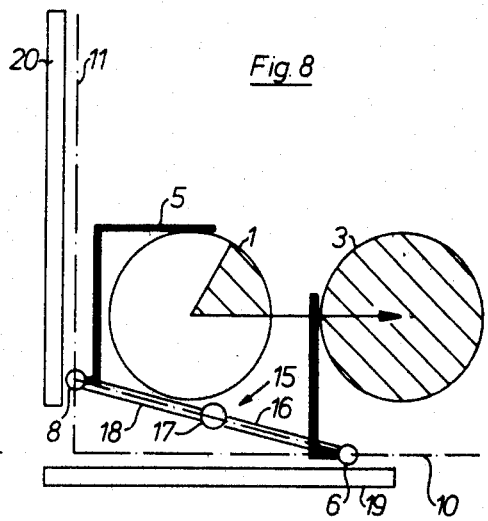
Figure 9:
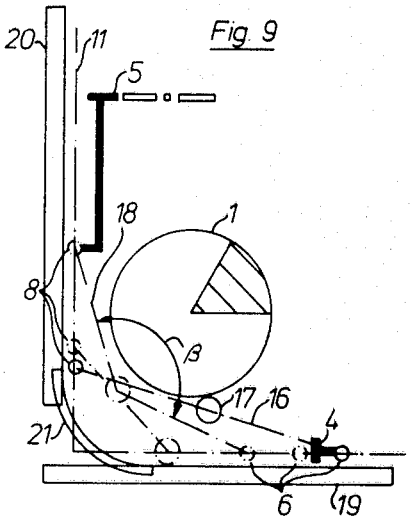
Figure 10:
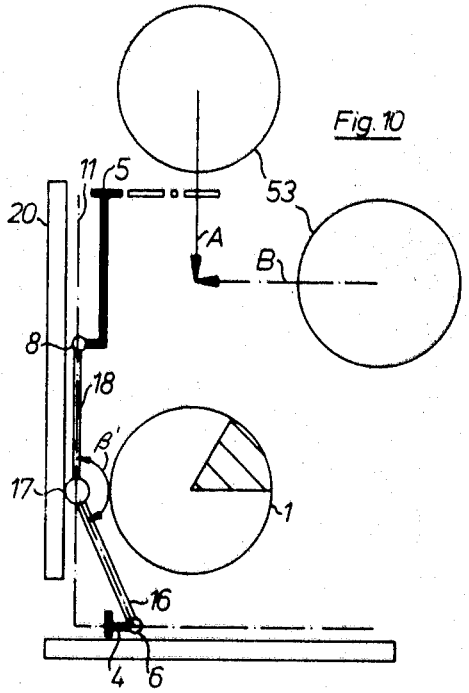
Figure 11:
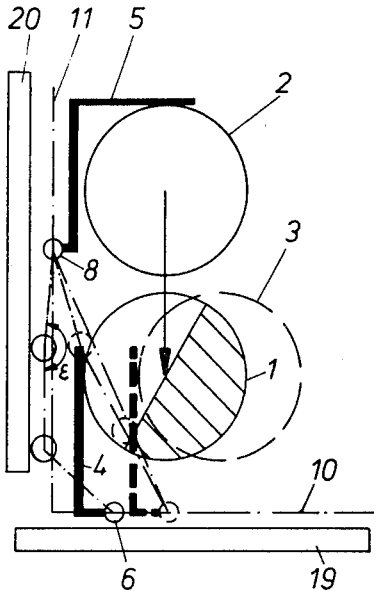
Figure 15:
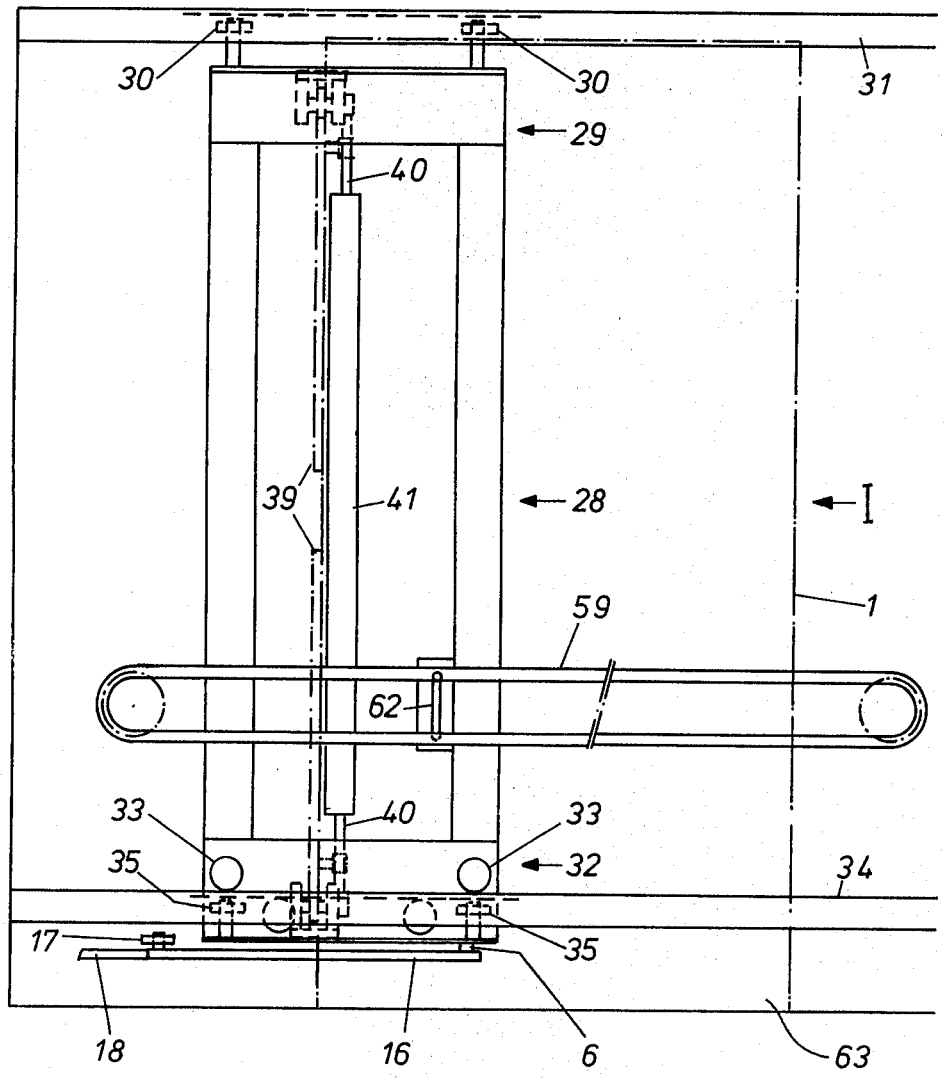
Figure 16:
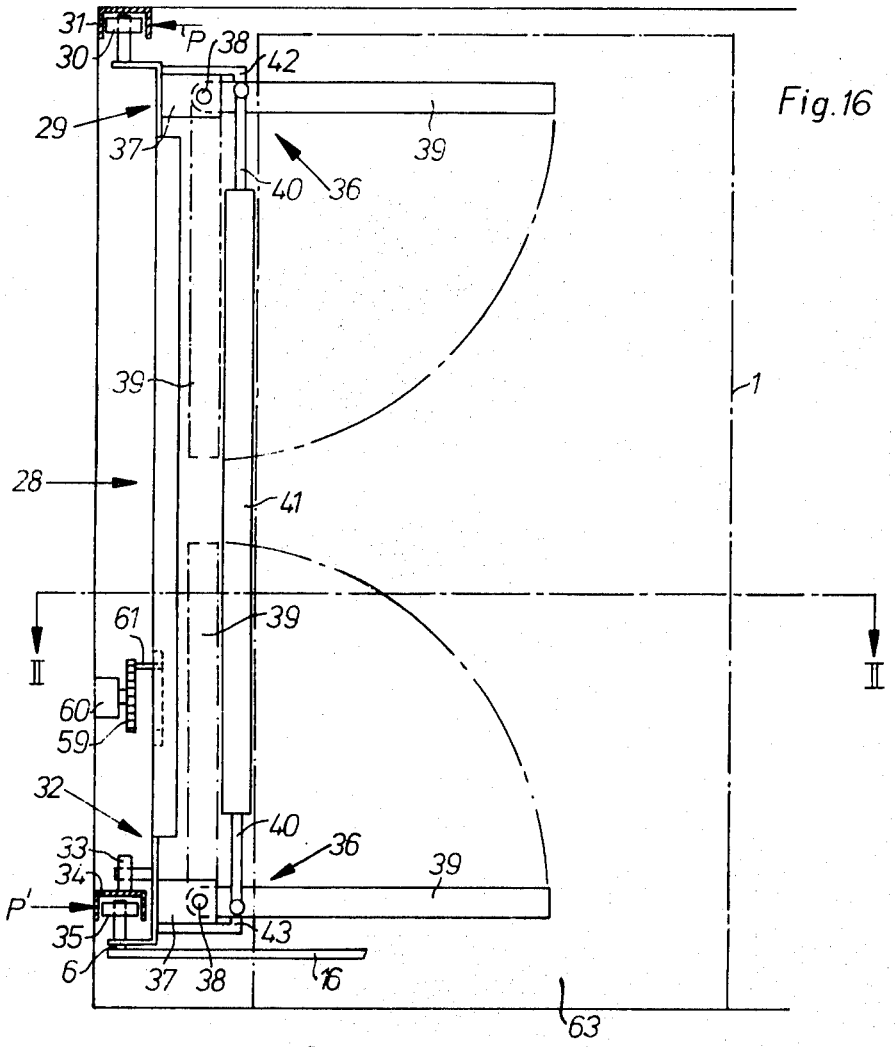
Figure 17:
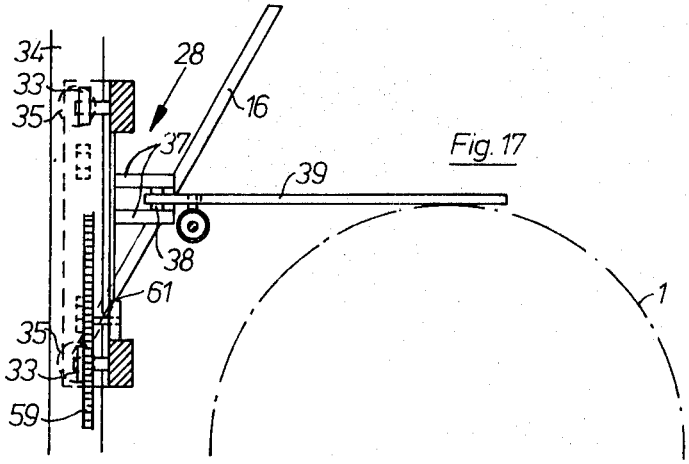
Figure 18:
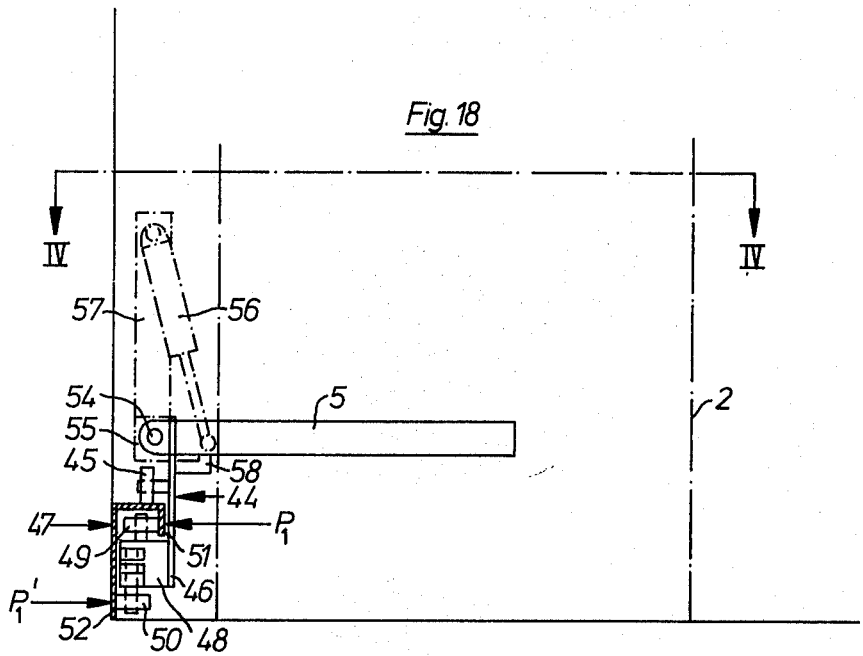

FIG. 3 graphically illustrates the movement functions of the apparatus of FIGS. 1 and 2;

FIG. 4 illustrates a top view of a second embodiment of a can changing apparatus according to the invention with a full can in a depositing position;

FIG. 5 illustrates a view similar to FIG. 4 with an empty can in the depositing position;

FIG. 6 graphically illustrates the movement functions of the can exchange apparatus of FIGS. 4 and 5;

FIG. 7 illustrates a top view of a third embodiment of a can exchanging apparatus according to the invention with a full can in a depositing position;

FIG. 8 illustrates a top view similar to FIG. 7 with an empty can in the depositing position;

FIG. 9 illustrates the position of the components of the can exchange apparatus of FIGS. 7 and 8 during a return motion;

FIG. 10 illustrates a further view of the apparatus of FIGS. 7 and 8 near the completion of a return stroke;

FIGS. 11 to 14 illustrate top views of a fourth embodiment of a can exchange apparatus according to the invention at different stages of operation;

FIG. 15 illustrates a part schematic view of the apparatus of FIGS. 7 to 10;

FIG. 16 illustrates a view taken in the direction of the arrow I of FIG. 15;

FIG. 17 illustrates a view taken on line II—II of FIG. 16;

FIG. 18 illustrates a view taken on line III—III of FIG. 7; and

Figure 19:
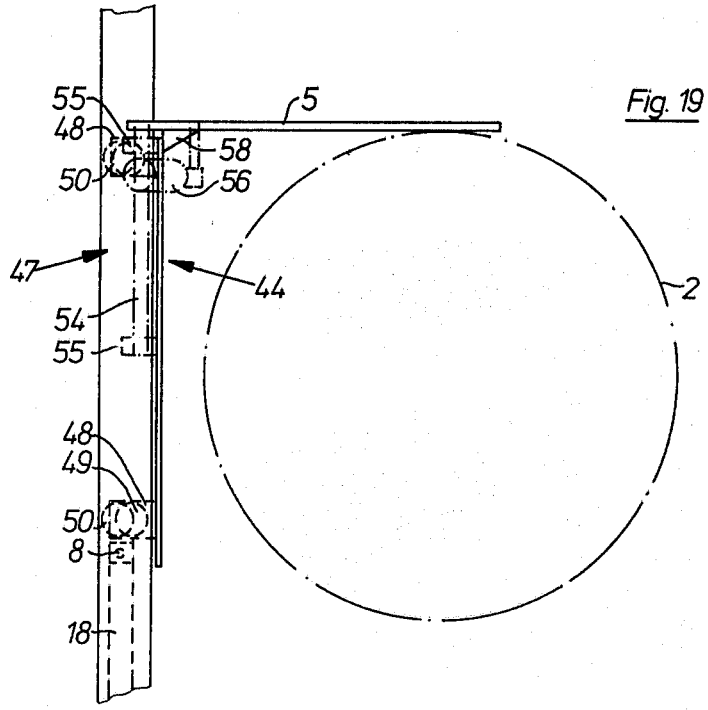

FIG. 19 illustrates a view taken on line IV—IV of FIG. 18.

Referring to FIG. 1, a can 1 to be filled is located in a so-called depositing position, an empty can 2 is located in a so-called reserve position and a full can is located in a transfer position. These three can positions are present in all of the following described embodiments and are referenced accordingly.

As shown, the can changing apparatus which is used, for example on a draw frame, includes a first arm 4 which is movable between an extended position engaging a can 1 in the depositing position and a retracted position (FIG. 2) as well as a second arm 5 for engaging the can 2 in the reserve position. The arm 4 is, for example, pivotable, so that in a starting position, the arm 4 is located immediately in front of the can 1 to be filled. The second arm is located in a starting position immediately in front of the empty can 2.

The arm 4 and a link member 6 are mounted on a support member 7 to be further described below. Likewise, the arm 5 and a link member 8 are mounted on a support member 9 (not shown). The first support member 7 is shiftable forward and backward on a first path 10 while the other support member 9 is shiftable forward and backward on a second path 11 which is disposed substantially at a right angle to the path 10.

As shown, a shifting means in the form of a rigid curved rod 12 interconnects the support members 9, 10 to each other in a force-transmitting manner. The rod 12 is bent, as shown in FIG. 2, in such a manner that during the shifting back of the support members 9, 10 between the end positions of the arms 4, 5 the rod 12 does not touch the can 1 to be filled. Furthermore, the rod 12 connects the support members 7, 9 such that if one member is driven, the other member is also shifted. For example, if the support member 7 is shifted with the full can 1 from the depositing position into the transfer position, the other support member 9 shifts the empty can from the reserve position to the depositing position.

The guide paths 10, 11 can be defined by straight guide elements (not shown) which are disposed at right angles to each other to receive a respective support member 7, 9 for shifting of the support members thereon. In addition, a suitable drive means (not shown) is connected to at least one of the support members for reciprocating the members 7, 9 on the respective guide elements.

In order to avoid contact with the can 1 during a backward shifting movement, the arm 4 is pivotable from a horizontal position (FIG. 1) to a vertical position (FIG. 2). Likewise, the arm 5 may be pivotable into a vertical position (not shown) if an empty can is supplied from a direction A in line with the arm 5 as shown in FIG. 2. However, if an empty can is to be supplied from the direction B transverse to the path of movement of the arm 5, the pivoting motion of the arm 5 can be eliminated.

The speed ratio of the forward shiftable support members 7, 9 which are interconnected by the rod 12 is shown in FIG. 3. Assuming that the support member 7 is shifted at a constant speed, the other support member 9, due to the rigid connection via the rod 12 and the the arrangement of the paths 10, 11 at right angles, shifts at a speed characteristic corresponding to a tangent function for an angle $\alpha$ (FIG. 1) between 0° and 90°. The tangent of the angle $\alpha$ is determined by the quotient of the angle legs a, b (see FIG. 2, i.e. $a/b = \tan \alpha$). The leg a corresponds to the distance between the rotational axis (not shown) of the link member 6 and to the projection of the intersection of the two paths 9, 11 as projected onto an imagined base plane while the leg b corresponds to the distance between the rotational axis of the link member 8 and the intersection point.

In order to avoid an excessive end speed of the support member 9 and of the empty can, the cans reach the new intended positions as the angle $\alpha$ reaches approximately 75°, i.e. with the empty can having reached the depositing position and the filled can having reached the transfer position.

At an angle of 45°, the speed of the empty can 2 equals the speed of the full can 1 as the tangent function at 45° has the value 1. That is, the accelerated can at 45° moves at the same speed as the can driven at constant speed. Thus, as the can 1 moves at a predetermined constant rate of speed from the depositing position to the transfer position, the empty can 2 is accelerated from the reserve position up to the speed of the filled can 1 at a point between the reserve position and the depositing position. Thus, the starting speed of the empty can 2 is substantially less than the filled can 1.

As can be seen from FIG. 3, the distance covered is $s=\bar{v}\cdot t$ [m]. As the time t is the same for both movements, the total distance covered by the full can is $s1=v_l\cdot t$, and the total distance covered by the empty can is $s2=\bar{v}_l\cdot t$. The two values are shown hatched in FIG. 3.

The angle $\alpha'$ (FIG. 1) resulting from the starting position of the two arms 4, 5 and thus of the link members 6, 8 depends upon the lay-out of the change apparatus and, in FIG. 3, e.g. has been chosen as 12 degrees.

As indicated in FIG. 3, the range of initial speeds (e.g. for the angles $\alpha$ between 12 and 30 degrees) of the empty can 2 show a markedly lower average speed than the speed of the full can 1.

If, in an alternative example, the support member 9, and thus the arm 5, is driven at a constant speed, the speed of the full can 1 follows a tangent characteristic. In this case, however, care should be taken, that the lay-out of the change apparatus should not yield an angle $\alpha$, at which too high a pressure load is imposed on the link member 6.

Referring to FIGS. 4 and 5, wherein like reference characters indicate like parts as above, the shifting means may be in the form of a resiliently bendable rod 13 which is pivotally secured at each end to a respective support member 7, 9. Further, to avoid contact of the rod 13 with the can 1 in the starting position of the arms 4, 5 (FIG. 4), the rod 13 is not completely straight. Thus, the distance $s_2$ over which the link member 8 moves from an end position at which the arm 5 starts shifting an empty can 2 to an outer end position is limited.

During operation, the support member 7 is driven to move forward and backward at constant speed. During a can change operation, the link member 8 starts moving only after the link member 6 has already moved so far that the rod 13 has reached a straightened position, i.e. that the angle $\alpha'$ has been increased to $\alpha''$. The particular values of these angles depends upon the lay-out of the apparatus.

Upon reaching the angle $\alpha''$, the link member 8 then follows a speed characteristic according to the tangent function shown in FIG. 6. The movement of the link member 6, 8 continues as described above until the angle $\alpha$ has reached a value of substantially 75°.

A damping means, such as a damping cylinder (not shown) is connected to the support member 9 in order to retard a backward movement thereof during a return stroke. In this case, the damping cylinder has a piston which is rigidly arranged and active only during a backward shifting movement. To this end, the piston (not shown) is connected with the link member 8 to retard the backward shifting movement of the link member 8 and the support member 9 with respect to the constant speed of the support member 7. Retardation occurs in such a manner that the rod 13 is bent. Thus, contact of the rod 13 with the can 1 is avoided. The amount of bending can be chosen by adapting a controllable dampening effect of the dampening cylinder.

The force which is stored due to the bending of the rod 13, in principle causes the backward shifting of the support member 9 up to the end of the limited path distance $s_2$ and prevents a further shifting of the support member. To this end, the stroke of the piston (not shown) of the dampening cylinder (not shown) can be limited.

The rod 13 can be made of a suitable material such as plastic, glass or textile fibers.

Referring to FIG. 6, the hatched areas indicate the paths s1 and s2 travelled by the full can 1, and the empty can 2, respectively, during the change process.

In this process, the shifting time t1 is the time duration required until the rod 13 is straightened, and t2 is the time duration of the common shifting movement. Thus, it is found that $s1=(t1+t2)\cdot v_L$ and $s2=t2\cdot v_T$.

Referring to FIGS. 7 to 10, wherein like reference characters indicate like parts as above, the shifting means interconnecting the support members 7, 9 is in the form of a link rod 15 which is pivotally secured at each end to a respective member 7, 9. As shown in FIG. 8, the link rod 15 has at least two equal legs (or links) 16, 18 and a link 17 pivotally connecting the legs 16, 18 together. As indicated, one leg 16 is pivotally connected to the link member 6 while the leg 18 is pivotally connected to the link member 8. In addition, a pair of guide rails 19, 20 is provided parallel to the guide elements (not shown) which define the guide paths 10, 11. These guide rails 19, 20 guide the link 17 thereon in a manner as described below while also serving as a stop for the link 17.

A suitable drive means is also connected with the support member 7, to drive the support member 7 back and forth at a constant speed.

During a can change process, the link member 8 starts moving only after the link member 6 has already been shifted so far that the link leg 15 is extended to a stretched position as indicated in FIG. 7, i.e. that the angle $\alpha'$ has increased to the value of the angle $\alpha''$. In this arrangement, the values of the two angles depend upon the lay-out of the change apparatus. Upon reaching the angle $\alpha''$, the link member 8 begins to show a speed characteristic corresponding to the tangent function shown in FIG. 6. The shifting movement of the link member 6 then continues until the angle $\alpha$ has reached a value of substantially 75° (FIG. 8).

As a support member 7 begins to shift backwards, the link rod 15 becomes bent (see FIG. 9) until the link 17 contacts the guide rail 19. The link 17 then slides along the guide rail 19 until a maximum bending angle $\beta$ is reached. This limitation of the bending angle $\beta$ is effected using a stop (not shown) in the link 17. As the link 17 shifts along the rail 19, the other support member 9 is necessarily shifted along the rail path 11 via the link member 8. Upon reaching the angle $\beta$, the link 17 is lifted off the rail 19 and deflected until coming into contact with the guide rail 20. The link 17 then slides along this guide rail 20 until the support members 7, 9 have reached the respective starting positions again (FIG. 10).

As the link 17 slides along the rail 20, the bending angle $\beta$ again opens up to a determined value $\beta'$. The value of these angles $\beta$ and $\beta'$ depend on the lay-out of the change apparatus.

The bending of the link rod 15 at the beginning of the backward shifting motion can be effected such that the link rod 15 bends upon shifting the can 1 or in providing a further stop (not shown) in the link 17 in order to prevent complete straightening of the link rod 15.

Alternatively, instead of providing the first mentioned stop in the link 17 to prevent bending at an angle below the value $\beta$, a means in the form of a curved rail 21 may be provided for guiding the link 17 from the guide rail 19 to the guide rail 20.

Referring to FIGS. 11 to 14, the shifting means may also be in the form of a link rod 22 which is made up of three parts. That is, the link rod 22 consists of a rod 23 connected to the link member 6, a rod 24 connected to the link member 8 and an intermediate rod 27 connected via a link 25, 26, with the rods 23, 24, respectively. The link rod 27, in turn, connects the support members 7, 9 in a linked force-transmitting manner. As above, the support member 7 is driven and moves forward and backwards at constant speed.

In order to avoid a complete straightening of the link rod 22, the link 26 is provided with a stop (not shown) which permits straightening up to a determined angle of $\eta$. In this manner, a desired bending direction of the link rod 22 is predetermined and a contact between the link rod 22 and the can 1 can be avoided depending on the lay-out of the apparatus.

Figure 13:
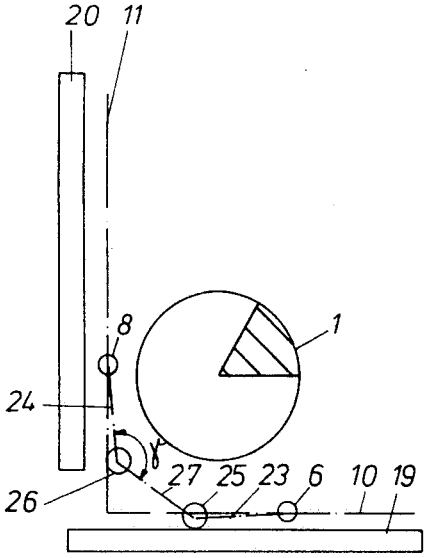
Figure 14:
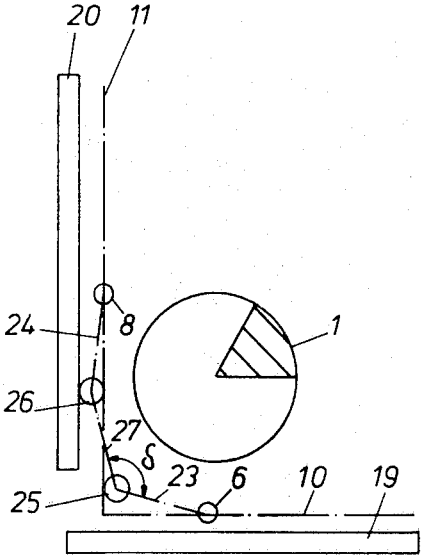

As these support members 7, 9 are shifted backewards, as shown in FIGS. 13 and 14, the link 26 first bends and then contacts the rail 19. The link 26 then slides along the rail 19 until a maximum bending angle $\gamma$ is reached.

Figure 12:
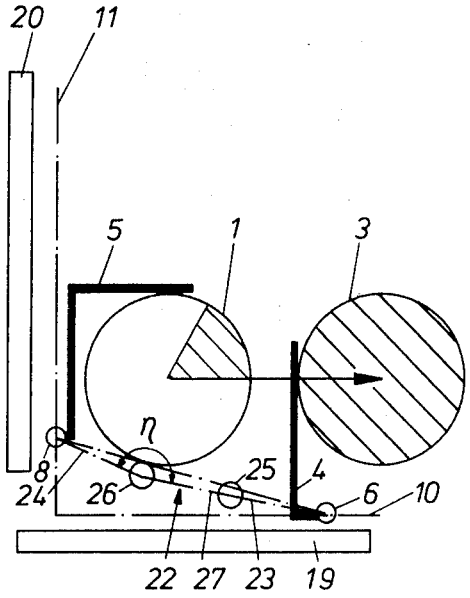

At the latest, upon a subsequent lifting off of the link 26 from the rail 19, the link 25 also bends and slides along the rail 19 until a maximum bending angle $\delta$ is reached. Whether the two bending angles $\gamma$ and $\delta$ are equal, or different, depends on the lay-out of the apparatus. However, the angle $\epsilon$ (FIG. 11) is not to exceed the angle $\eta$ (FIG. 12).

Instead of using stops in the links 25, 26, the rails 19, 20 can be used with a bent rail such as rail 21 as shown in FIG. 9, in order to determine the maximum bending angles $\gamma$ and $\equiv$. In this case, the links 25, 26 would slide along the rail 19 over to the rail 20.

Referring to FIGS. 15 to 19, the support member 7 includes a carriage 28 having an upper part 29 on which two rolls 30 are rotatably mounted. These rolls 30 are guided on an upper rail 31 which forms a first part of the path 10. The rolls 30 serve to horizontally guide the support member 7.

The support member 7 also has a lower part 32 on which two rolls 33 are rotatably mounted for vertically guiding and supporting the support member 7. These rolls 33 are supported on a lower rail 34 which forms a second part of the path way 10. Of note, the rails 31, 34 are mounted on a machine housing 63 of the change apparatus (not shown).

The carriage 28 also has a pair of rolls 35 rotatably mounted on the lower part 32 for further horizontal guidance of the support member 7. The resulting reaction forces P, P' (see FIG. 16) generated at the rolls 30, 35 on the corresponding rails 31, 34 are mutually opposed.

The link member 6 is also mounted on the lower part 32 of the carriage 28 and is linked to the rod or leg 16.

A pivotal arm 36 (see FIG. 16) is mounted on each of the upper part 29 and lower part 32 of the carriage 28. These two arms form the first arm 4 mentioned earlier. The arms 36 each comprise a support 37, a link pin 38 which is rigidly arranged in the support 37 and an arm leaf 39 which is pivotally mounted on the pin 38. In order to pivot each arm leaf 39 from a horizontal position as shown in FIG. 16 to a vertical position as shown in FIG. 16 to a vertical position (shown in dash-dotted lines in FIGS. 15 and 16) a piston rod 40 of a double action pneumatic cylinder 40 is pivotally connected with the arm leaf 39. A stop 42 in the upper part 29 and a stop 43 in the lower part 43 serve to limit the position of the respective arm leafs 39 in the pivoted out positions. The vertical position of each arm leaf 39 is defined by a limited backward lift stroke of the cylinder pistons 40.

Referring to FIGS. 18 and 19, the support member 9 comprises a carriage 44 on which two upper rolls 45 are rotatably mounted on a longitudinal member 46. The rolls 45 support the carriage 44 vertically on a rail 47 which forms the second path 11. Furthermore, an upper roll 49 and a lower roll 50 are each rotatably mounted on two supports 48 (only one of which is shown in FIG. 18) which are mounted on the longitudinal member 46. As indicated, one roll 49 rolls on a short leg 51 while the other roll 50 rolls on the long leg 52 of the rail 47 so as to support the carriage 44 in its horizontal position. The reaction forces $P_1$ and $P_1'$ generated on the legs 51, 52 by the rolls 49, 50 are mutually oppossed.

As indicated, in dash lines in FIG. 19, the member 8 forms a part of the support 48.

The arm 5 is rigidly connected to the longitudinal member 46 in case a can 53 is brought into the change apparatus from the direction B (see FIG. 10). If the can 53 is to be supplied from the direction A, the arm is pivoted about an axis 54. For example, a pin may define the axis 54 and may be rotatably supported in two bearing elements 55 mounted on the longitudinal member 46. In order to pivot the arm 5, a pneumatic cylinder arrangement 56 is connected on the cylinder side to a support 57 on the longitudinal member 46. In order to pivot the arm 5, a pneumatic cylinder arrangement 56 is connected on the cylinder side to a support 57 on the longitudinal member 46 and on the piston side to the arm 5. In order to fix the arm 5 in a horizontal position, a stop 58 is provided on the longitudinal member 46.

The carriage 28 is driven using a chain drive arrangement 59 which is activated by a gear motor 60 (shown only partially in FIG. 16). An extended chain pin 61 (FIG. 17) protrudes into a guide groove 62 provided on the carriage 28 (FIG. 15) and is used for transmitting the drive force from the chain drive 59 to the carriage 28. The support arrangement of the chain drive arrangement and the fixation of the gear drive motor are not shown.

What is claimed is:

1. An apparatus for changing cans on a spinning preparatory machine, said apparatus comprising a pair of shiftable support members, each having an arm movably mounted thereon between an extended position for engaging a can and a retracted position spaced from the can;

a pair of straight guide elements disposed at right angles to each other, each said guide element receiving a respective support member for shifting of said respective support member thereon;

a shifting means interconnecting said support members to each other in a force-transmitting manner; and a drive means connected to at least one of said support members for reciprocating said members on said respective guide elements.

2. An apparatus for changing cans on a spinning preparatory machine, said apparatus comprising a first shiftable support member having a first arm movably mounted thereon between an extended position engaging a can in a depositing position and a retracted position spaced from the can;

a first straight guide element for shifting of said first member thereon;

a second shiftable support member having a second arm mounted thereon for engaging a can in a reserve position;

a second straight guide element disposed at a right angle to said first guide element for shifting of said second member thereon;

a shifting means interconnecting said support members to each other in a force-transmitting manner; and a drive means connected to at least one of said support members for reciprocating said members on said respective guide elements.

3. An apparatus as set forth in claim 2 wherein said shifting means is a rigid curved rod pivotally secured at each respective end to a respective support member.

4. An apparatus as set forth in claim 2 where said shifting means is a resiliently bendable rod pivotally secured at each respective end to a respective support member, said drive means is connected to said first support member and a damping means is connected to said second support member to retard a backward movement thereof whereby during a backward movement of said support members, said rod bends away from a can placed in said depositing position.

5. An apparatus as set forth in claim 2 wherein said drive means is connected to said one support member and said shifting means is a link rod pivotally secured at each respective end to a respective support member, said rod having at least two equal legs and a link pivotally connecting said legs together, and which further comprises a first guide rail parallel to said guide element for guiding said link thereon, a second guide rail parallel to said second guide element for guiding said link thereon, and a means for guiding said link from said first guide rail to said second guide rail.

6. An apparatus as set forth in claim 5 wherein said means for guiding said link is a stop in said link for preventing a bending of said link rod below a predetermined angle.

7. An apparatus as set forth in claim 5 wherein said means for guiding said link is an arcuate guide interconnecting said rails to each other.

8. An apparatus as set forth in claim 2 wherein said second arm is pivotally mounted on said second support member.

9. A method of changing cans on a spinning preparatory machine, said method comprising the steps of shifting a first can in a first direction at a predetermined rate of speed from a depositing position to a transfer position, and simultaneously shifting an empty second can in a second direction substantially at a right angle to said first direction from a reserve position to said depositing position while accelerating the empty second can from a reserve position up to the speed of the first can at a point between said reserve position and said depositing position whereby the starting speed of the second can is substantially less than the speed of the first can.

10. A method as set forth in claim 9 wherein the rate of speed of the first can is subtantially constant.

11. A method as set forth in claim 9 wherein the speed of the second can corresponds to a tangent function from 0° toward 90°.

12. A method as set forth in claim 9 wherein the second can moves from said reserve position with time delay after the first can moves from said depositing position.

* * * * *